United States Patent [19]

Stade et al.

[11] 4,027,490

[45] June 7, 1977

[54] SELF-SINKING, AXIAL PASSAGE FOUNDATION PILE AND METHOD

[75] Inventors: Heinrich Stade, Heide, Holstein; Klaus David, Kiel, both of Germany

[73] Assignee: Heinrich Stade, Heide, Holstein, Germany

[22] Filed: Sept. 10, 1975

[21] Appl. No.: 612,196

[52] U.S. Cl. ..... 61/53.5; 175/258; 175/292

[51] Int. Cl.[2] ..... E02D 7/28

[58] Field of Search ..... 61/53, 53.5, 56, 53.68, 61/53.6; 175/171, 292, 258, 263

[56] References Cited

UNITED STATES PATENTS

| | | | |
|---|---|---|---|
| 428,021 | 5/1890 | Rothwell | 175/171 X |
| 1,052,847 | 2/1913 | Repp | 175/292 |
| 2,716,018 | 8/1955 | Williams | 175/171 X |
| 2,990,896 | 7/1961 | Kandle | 175/171 |
| 3,369,618 | 2/1968 | Moore | 175/171 X |
| 3,608,652 | 9/1971 | Medders | 175/171 X |
| 3,745,776 | 7/1973 | Hubby | 61/53.6 |
| 3,864,923 | 2/1975 | Turzillo | 61/53.6 |

FOREIGN PATENTS OR APPLICATIONS

| | | | |
|---|---|---|---|
| 1,484,392 | 6/1969 | Germany | 61/53.6 |

*Primary Examiner*—Dennis L. Taylor
*Attorney, Agent, or Firm*—Armstrong, Nikaido & Marmelstein

[57] ABSTRACT

A self-sinking, axial passage foundation pile and method are provided. The pile is preformed with an axial bore which is capable of accommodating a rotatable shaft. At one end of the pile a drill bit is affixed to the shaft and at the other end a driving means is attached to the shaft in order to rotate the drill bit. In this configuration the rotational drilling torques are transmitted by the shaft without importing torque to the pile. Accordingly, the pile need not be specially reinforced to accommodate the bore hole drilling torques. Furthermore, the invention encompasses the novel method for installing the unique pile disclosed.

9 Claims, 8 Drawing Figures

26
8
18
20
10
10
2
1
3
4
17
19
7
13
11
5

SELF-SINKING, AXIAL PASSAGE FOUNDATION PILE AND METHOD

BACKGROUND

1. Field of the invention

The invention relates to an improved foundation pile and process for preparing pile foundations using the improved pile.

2. The prior art

In cases where the foundation soil below the foundation level of a building consists of ground of inadequate bearing strength, loading can of course be transferred by piles to stronger layers of earth available at greater depth. The piles used to transmit the loading to the stronger earth are either precast concrete piles or in-situ piles. Further subdivisions, depending upon the process used to prepare the piling, are drilled piles and driven piles.

In one known process for the preparation of pile foundations using precast concrete piles, precast concrete or reinforced concrete piles are driven into the ground by means of a monkey or tup or the like to the depth of the bearing layers; an equal volume of earth is displaced with the possible result, more particularly in soft clays, that previously positioned piles of the same foundation may move horizontally. Furthermore, driving a precast concrete pile of that type into the ground produces substantial vibrations which may endanger nearby buildings or previously driven piles. Additionally, it is difficult to ascertain the final condition of a pile which has been driven into the ground, since the pile may be damaged, for instance, by the driving forces; the corresponding damage is underground and cannot be checked. As a result, the pile can fracture without detection while being driven.

It is also known in the art to use driven piles made of on-site concrete for pile foundations. A jacket tube or form is driven into the ground and cleared internally and the concrete pile is prepared on-site in the tube; after the concrete is set, the jacket tube or form is removed. The advantage of pilings of this kind over ordinary driven piles is that a pile base can be prepared by reaming the ground below the form or jacket tube so that foundation loading can be increased. Disadvantages of this known process are that preparation on site is very tedious; also, it is often impossible to utilize pile foundations using driven form piles made of on-site concrete in soft ground since the ordinary or reinforced concrete which forms an individual pile receives inadequate transverse support from the soft ground, in which event the unset concrete may mix with the earth, thereby degrading uniform quality of the pile.

To obviate disadvantages associated with driven piles of the two kinds hereinbefore described, pile foundations can be prepared with the use of drilled piles, which as in the previous case are on-site piles whose sinking tubes are sunk by drilling rather than driving. This process can be used with minimal vibration and in places where space is restricted. In this known process, to assure that the pile has adequate bearing strength, the concrete is injected or vibrated into the surrounding earth while the jacket or form tubes are pulled. Drilled piles of that kind can be devised as end-bearing piles, the pile foot being thickened, more particularly in sticky ground. To that extent, the ground near the pile end is reamed out by appropriate facilities. Since the operation is free from vibration and since there is no question of an equal volume of earth being displaced, pile foundations of this kind are particularly useful in building gaps. The main disadvantage of this process is its high cost and relatively severe settling which arises because drilling causes some loosening of the bearing layer of earth. Also, the preparation of this kind of on-site pile calls for considerable skill and attention on the part of the person in charge of drilling the pile foundation. If undesirable seeping water is not observed in the drilling tube below the real watertable level, ground settlement may occur because of hydraulic ground pressures which may then damage adjacent buildings. That occurs often in practice. Another disadvantage of the known process is that, as always with on-site piles, the quality of the finished pile is difficult to ascertain since the concrete might mix with the earth around it.

According to an earlier suggestion of mine to obviate the disadvantages of the processes, using precast concrete piles, a hole adapted to the pile diameter is drilled in the ground as deeply as the region of bearing layers, the pile is then guided into the bore hole, whereafter the pile is rammed tight like a driven pile, producing an anchorage in the bearing layers of earth. In this known suggestion the advantages of a driven pile are combined with the advantages of drilled piles.

According to another development based upon my suggestion, the process is improved by the bore hole being drilled directly be means of the precast concrete pile which is devised for flushing the bottom end of the bore hole and which has a scrifice drilling bit at its bottom end. This feature helps considerably to simplify and cheapen the process; the only disadvantage is that the pile used for direct drilling must have additional steel reinforcement to accommodate drilling torques.

The disadvantages observed in the prior art are overcome by the instant invention as will be hereinafter set out.

BRIEF SUMMARY AND OBJECTS OF THE INVENTION

The instant invention comprises a novel self-sinking, axial passage foundation pile and method. The pile is preformed with an axial bore which is capable of accommodating a rotatable shaft. At one end of the pile a drill bit is affixed to the shaft and at the other end a driving means is attached to the shaft in order to rotate the drill bit. In this configuration the rotational drilling torques are transmitted by the shaft without importing torque to the pile. Accordingly, the pile need not be specially reinforced to accommodate the bore hole drilling torques. Furthermore, the invention encompasses the novel method for installing the unique pile disclosed.

It is, therefore, a primary object of the invention to provide a self-sinking axial passage foundation pile which accommodates a drilling torque transmission shaft within an axial passage.

It is another primary object of the invention to provide a novel method for installing the unique pile.

These and other objects and features of the invention will become more fully apparent from the following description and apended claims taken in conjunction with the drawing.

BRIEF DESCRIPTION OF THE DRAWING

FIG. 6 is a side view of proceedings when the pile is being driven in.

DETAILED DESCRIPTION OF THE PREFERRED EMBODIMENT

INTRODUCTION

Figure 1A:
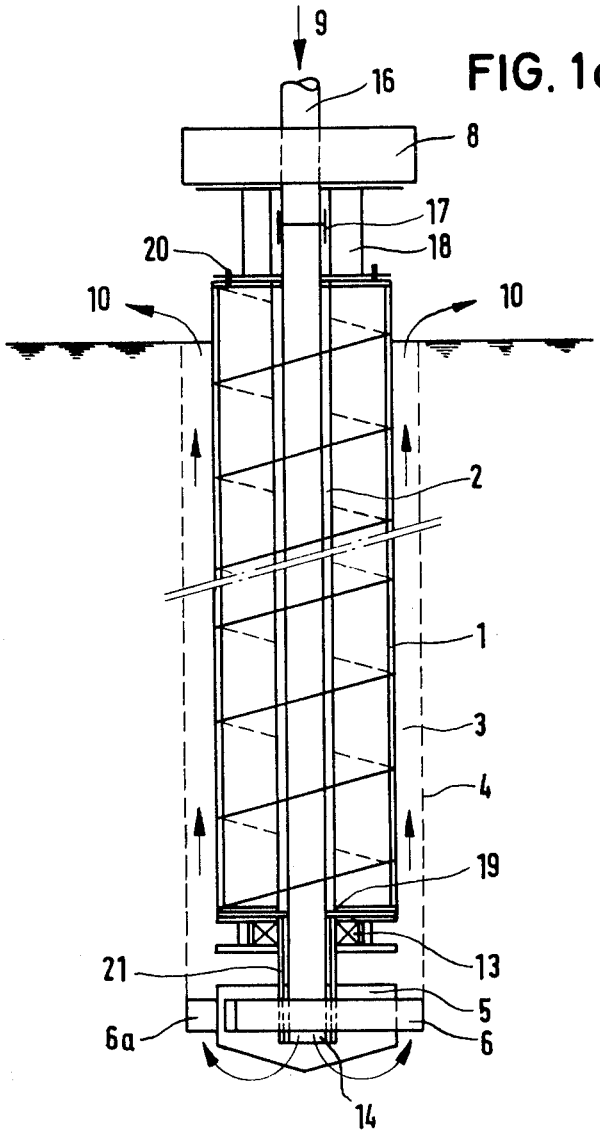
FIG. 1*a* shows the step in the process of sinking the bore hole by means of the precast concrete pile, the view being in side elevation.

The instant invention comprises a process for preparing pile foundations using precast concrete piles having an axial passage. On the bottom end of the pile is a rotatably mounted sacrifice drilling bit having a drill pipe attachment site. The pile is suspended and secured against rotation. A drill pipe is positioned within the axial passage and attached to the rotatable bit. As the drill pipe and bit rotate, the pile and drilling assembly is lowered to the depth of the bearing layers of soil. A flushing flow of a carrying liquid is used to conduct the drillings to the surface through an annular chamber between the pile and the earth surrounding it. The carrying liquid is conveyed to the end of the pile through the drilling pipe. After reaching the bearing layer, the drill pipe is removed and the pile and drill bit are rammed tight in a fashion similar to a driven pile.

The invention provides more particularly the advantage of considerably simplifying and reducing the cost of drilled piles. Also, it enables the sacrifice chisel at the bottom end of the pile to form an anchorage therefor, so that a precast concrete pile positioned in accordance with the invention can also be used as a pile adapted to withstand tension.

It is also an aspect of the invention to partially withdraw the pile before it is rammed tight, whereafter a thixotropic substance is poured through the continuous passage in the pile as a retaining agent or lubricant and/or to provide protection against corrosion. The thixotropic substance is continuously pumped until it comes out at the surface through the annular chamber.

Preferably, upon reaching foundation level the drilling bit at the end of the pile is enlarged radially, whereafter the borehole is formed with a widened base, the drillings also being conveyed to the surface through the annular chamber by the flushing action, then, after dismantling the drill pipe, freshly mixed concrete is forced through the continuous passage in the pile, with simultaneous lowering thereof as far as the region of the top-edge of the widened foot, into the chamber below the pile, whereafter the pile is driven tight. This feature provides the further advantage that, when the pile is driven into the concrete, the unset concrete and the earth in the immediate vicinity thereof is compacted, resulting in a pile end which has elevated bearing strength and which is received in a very compressed layer of earth.

Advantageously, before the injection of freshly mixed concrete, a thixotropic substance may be introduced as a retaining medium or lubricant and/or to provide protection against corrosion, the substance being later expelled by the freshly mixed concrete from the annular chamber at the surface. A bentonite suspension has proved satisfactory as an advantageous thixotropic substance.

The instant invention also provides an assembly comprising a precast concrete pile having a continuous longitudinal passage and which is of use in the process according to the invention, wherein the bottom end of the pile has a drilling bit rotatably mounted in a bearing; the bit presents a coupling site for the drill pipe, the coupling being coaxial with the passage; and at the top end of the pile a connection is provided for suspension on the drive head of the drill, the suspension operating to secure the pile against rotation. The advantage of the novel pile is that it can be produced without the need for reinforcement to accommodate high torques; the torque is transmitted by the drill tube which extends through the continuous passage to the drilling bit at the bottom end of the pile.

In an advantageous form of the pile, the drilling bit has additional cutters whose operative circle is adapted to widen radially. In that embodiment the additional cutters are pivoted on the drilling bit in a radially outward zone so that the resistance which the drillings exert in one direction of bit rotation pivots the extra cutters outward.

Advantageously, the bit has peripheral surfaces which serve as an abutment for the extra cutters in the most outwardly pivoted position. The bit can be associated by way of a short tubular member with the bearing on the pile. In a further development of this feature, the coupling is disposed inside the short tubular member; however, the coupling can be disposed at the top end of the short tubular member.

In a preferred embodiment of the precast concrete pile, sealing means associated with the drill pipe are provided, to prevent the agents and the freshly mixed concrete injected into the bottom of the bore hole from issuing between the drill tube and the continuous passage in the pile.

Advantageously, the sealing means engage the outside of the drill pipe and the walls of the passage. Generally, the sealing means take the form of a ring seal at the top end of the short tubular member discussed above.

When a precast concrete pile having an expandible bit is used, the process of the invention can be performed to provide the pile with a widened base. When the foundation level is reached the direction of drillpipe rotation is reversed to pivot out the additional cutters, whereafter a widened or undercut foot is reamed out. In order to pull the pile to the zone of the top edge of the widened base, the direction of drillpipe rotation is briefly reversed again to pivot in the additional cutters. Then freshly mixed concrete is injected, whereafter the pile is rammed tight.

DETAILED DESCRIPTION

The invention will now be described in detail with reference to the figures of the drawing.

FIG. 1 shows how a precast concrete pile 1 is secured by way of a connection 20 to suspension 18 on the stationary part of a drill drive head 8. A drilling bit 5 is rotatably mounted in a bearing 13 at the bottom end of pile 1. Extending through a continuous axial passage 2 in pile 1 is a drill tube 16 which is connected by way of a coupling 14 with drilling bit 5. At its top end, drill tube 16 is secured to the rotatable part of drill drive head 8. Consequently, and as can be seen in FIG. 1, bit 5 is rotated but the pile 1 does not experience any torques.

Bit 5 at the bottom end of pile 1 sinks bore hole 4; bit 5 is slightly larger in its operative diameter than the diameter of pile 1. In this stage of the process according to the invention, drill tube 16 is connected to a flushing facility 9 which provides a flushing medium flowing through drill tube 16 to the bottom of the bore hole and flushing the drillings upwards through an annular space or gap 3 between pile 1 and bore hole 4, in the manner indicated by arrows 10 in FIG. 1*a* which indicate the discharge of flushing medium mixed with drillings.

Figure 1B:
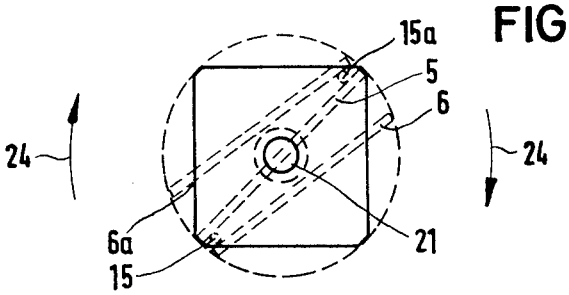
FIG. 1*b* is an inverted plan view corresponding to FIG. 1*a;*
Figure 2A:
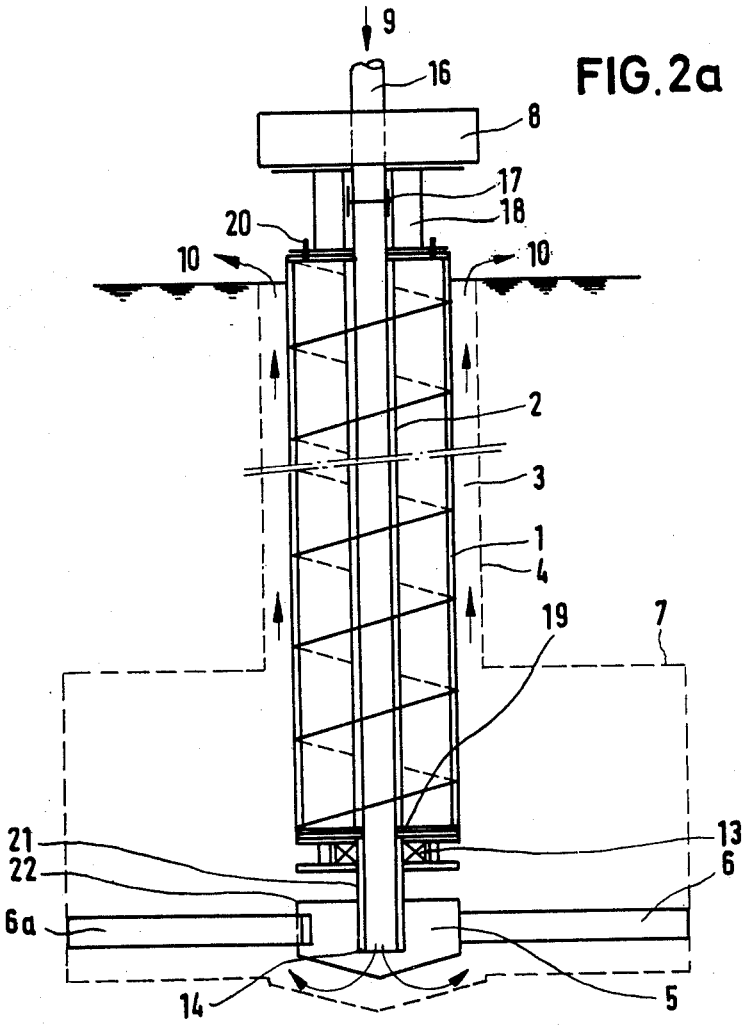
FIG. 2*a* and 2*b* are views corresponding to FIGS. 1*a* and 1*b* respectively of a subsequent step in the process for reaming out a widened base.

As can be seen in the bottom part of FIG. 1*a* and in FIG. 1*b*, the bit 5 at the bottom end of pile 1 — which is used just once and which is therefore devised as a sacrifice drilling bit — is of very simple construction; in the preferred embodiment shown, the bit 5 takes the form of a cutter to which additional cutters 6, 6*a* pivotable about axes disposed parallel to the pile axis are illustrated. Axes 15 and 15*a* of the additional cutters 6 and 6*a* are disposed near the outer periphery of pile 1. When in the inwardly pivoted state, which is shown in FIG. 1*a* and which is associated with the sinking of bore hole 4, the additional cutters 6 and 6*a* remain within the operative circle of drilling bit 5, such circle being slightly larger than the outer periphery of pile 1. When in the pivoted-out state shown in FIGS. 2*a* and 2*b*, the additional cutters 6 and 6*a* extend for a considerable part of their total length beyond the outer periphery of pile 1 and are prevented from further rotation by abutment surfaces 22 of bit 5.

When bit 5 rotates in a direction such that the additional-cutter axes 15 trail on the bit 5 in relation to the direction of rotation, friction with the drillings and with the bore hole wall keep the additional cutters 6, 6*a* in the pivoted-in position. When, however, the direction of rotation reverses the same friction causes the additional cutters 6 and 6*a* to pivot out and thus considerably increase the operative circle of bit 5.

In the embodiment shown, bit 5 is rotatably mounted in a very simple bearing 13 with the interposition of a short tubular member 21; the member 21 can be welded to a substantially square baseplate 23 which carries the main cutter and the additional cutters 6 and 6*a* of the bit 5. Member 21 is also open towards the bottom of the bore hole so that the flushing by way of the drill tube 16 and the supply of agents mentioned hereinafter reach the bottom of the bore hole. For sealing-tightness in relation to the drill tube 16, near the top member 21 or at the top end thereof there is a ring seal 19 which is connected to the pile 1 and which, when the drill tube 16 extends through pile passage 2 to the bottom of the bore hole, engages the drill tube 16. Also, there is provided in member 21 a coupling 14 which is a very simple device such as a dog clutch or the like.

Figure 2B:
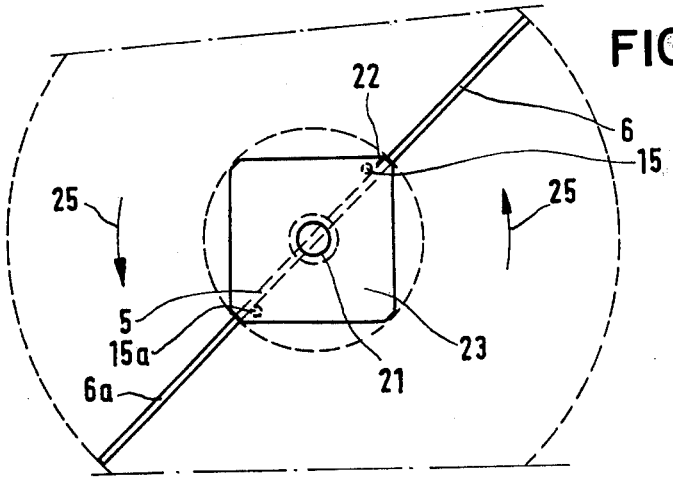

FIG. 2 shows a step in the process according to the invention wherein foundation level has been reached and the direction of rotation transmitted from drive head 8 through drill tube 16 to bit 5 has been reversed to pivot the additional cutters 6 and 6*a* about the axes 15 so that an undercut or a widened foot 6 is reamed out at the bottom end of hole 4. The corresponding drillings are carried to the surface through annular gap 8 by the flushing liquid 9. The reversal of rotation is indicated in FIG. 2*b* by arrows 25 which point in the opposite direction to the arrows 24 of FIG. 1*b*.

Figure 3:
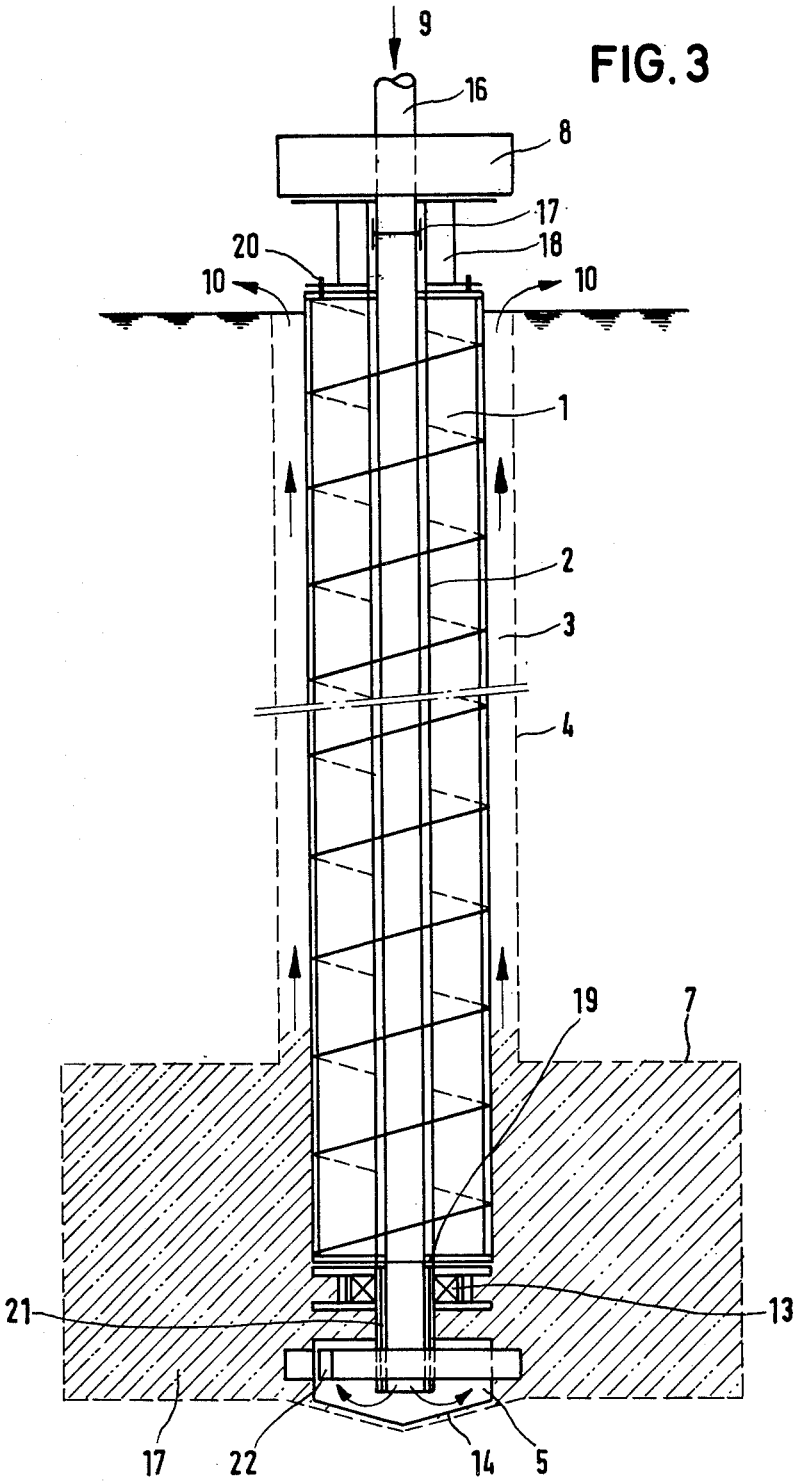
FIG. 3 is a side view in which the base has been completely reamed out and filled with a retaining or support medium.

FIG. 3 shows how, after a further reversal of the rotation of drill tube 16, the additional cutters 6 and 6*a* have pivoted back to a position inside the operative circle of bit 5 by pivoting about their axes 15. The reamed-out zone 7 is then filled through tube 16 with a retaining or bearing liquid which is usually a bentonite suspension. Injection of liquid 17 expels the flushing liquid — as a rule water — present in the zone 7.

Figure 4:
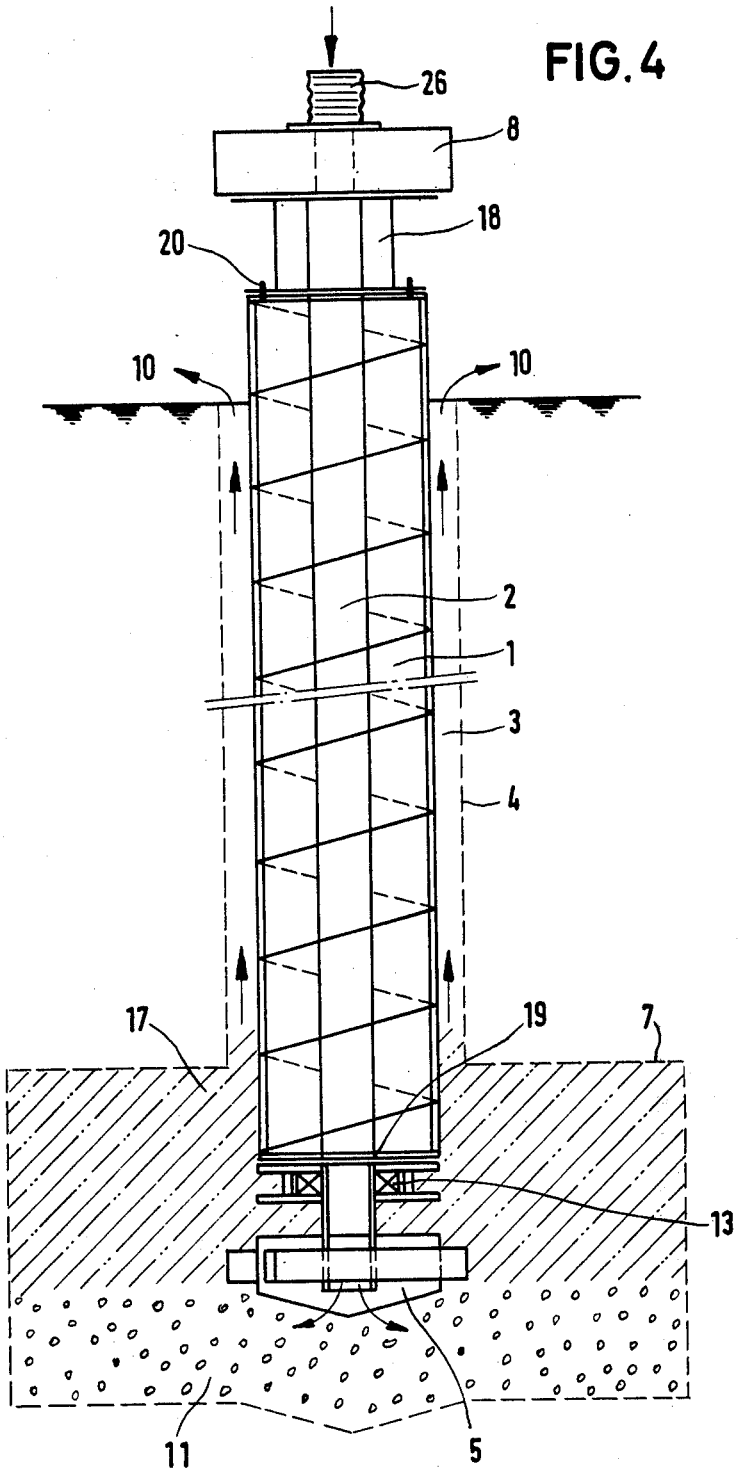
FIG. 4 is a side view which corresponds to FIG. 3 and in which the reamedout base has been partly filled with freshly mixed concrete.

In the next phase of the process, shown in FIG. 4, drill tube 16 has been released from the clutch or coupling and removed from pile 1. The pile continues to be connected by way of suspension 18 to the drill drive head 8; the drive head has a hose connection 26 which communicates with pile passage 2 and through which freshly mixed concrete 11 is injected into the bottom of the bore hole — i.e., in the zone 7 — simultaneous with the partial withdrawal of pile 1; the injected concrete displaces the filling 17 in annular chamber 3, the flushing liquid which remains therein issuing at the surface as again indicated in FIG. 4 by arrows 10.

Figure 5:
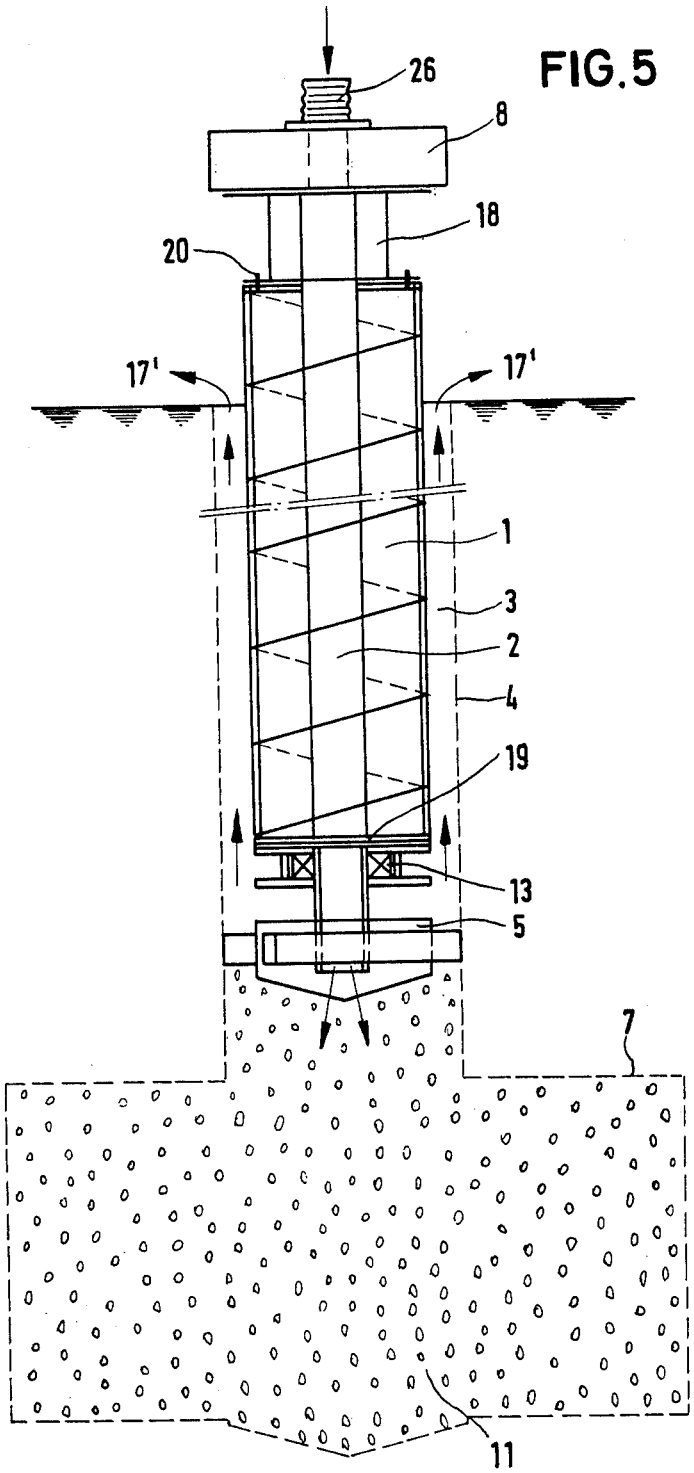
FIG. 5 shows the phase which follows FIG. 4 and in which the reamed-out base is completely full of freshly mixed concrete.

Referring now to FIG. 5, the entire zone 7 and approximately 1 meter of the pile stem is filled with freshly mexed concrete simultaneously as the pile 1 is continuously withdrawn. During this phase all the flushing liquid is displaced from space 3, and the retaining or support medium which had been injected into zone 7 also issues at the surface from space 3, as indicated by arrows 17′ in FIG. 5.

Figure 6:
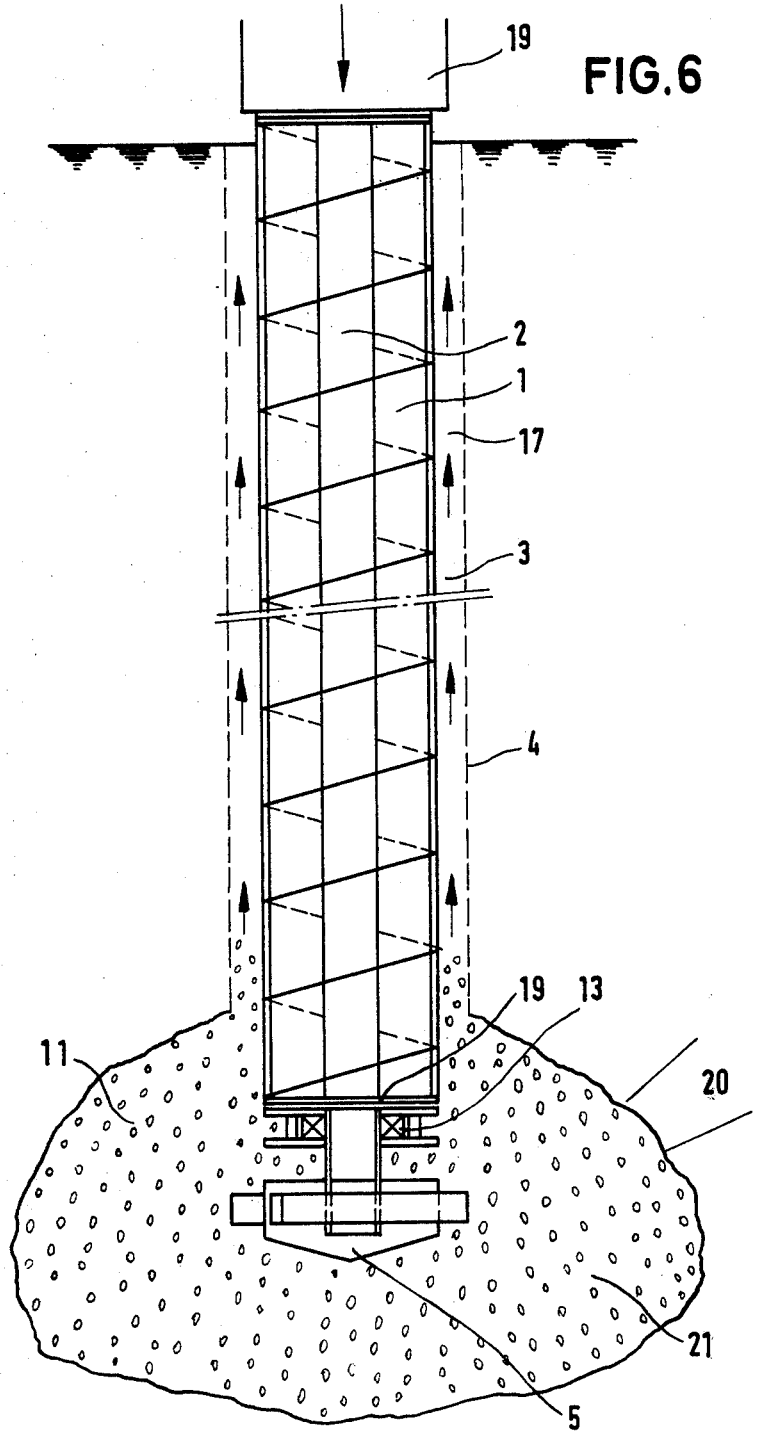

The drill drive head 8, the suspension 18 and the supply lines for flushing agent, concrete and thixotropic substance are then released from the top end of pile 1 and the same, as shown in FIG. 6, is driven into the concrete filling or charge 11 by means of a monkey 19, with the result that a pile vase 21 is formed of concrete disposed in compacted surrounding earth 20.

During this phase or step or the process the pile can, depending upon the special circumstances on site, be just pressed into the concrete charge 11, for instance, if very reduced vibrations are required in working, or the pile can be shaken tight. As FIG. 6 also shows, some thixotropic substance 17 remains in the space 3 and therefore serves as a support agent, as a lubricant against positive casing friction and as protection against corrosion by aggressive soil water.

The bit 15, the additional cutters 6 and 6*a*, the bearing 13 and the seal or gasket 19 remain on the pile 1 and also serve as anchorage which strengthens the pile against tensile forces.

Before or while the pile is being driven in by monkey 19, the continuous passage 2 in the pile 1 can be filled with freshly mixed concrete, the same subsequently solidifying to form a solid pile.

It should be recognized that the pre-formed pile can be made of any rigid material capable of supporting a foundation. Concrete piles have been discussed herein since that material is widely used at present.

All changes which come within the meaning and range of equivalency of the claims are to be embraced within their scope.

What is claimed is:

1. A self-sinking pre-fabricated concrete foundation pile assembly comprising:

a. a generally elongate rigid steel reinforced concrete pile having a centrally disposed axial bore opening on first and second ends of the pile;

b. rotatable shaft means rotatably disposed within the axial bore and extending from both the first and second ends of the pile for transmission of rotational torque through the pile, wherein said shaft means are removable from said axial bore;

c. drill bit means coupled to the portion of the shaft means extending from the second end of the pile for drilling a sinking hole for the pile;

d. securing means for preventing rotation of the pile; and e. rotatable driving means coupled to the portion of the shaft means extending from the first end of the pile for rotation of the shaft means and the drill bit means, wherein said drill bit means is releasably coupled to said shaft means and rotatably supported by the pile and includes expandable cutting means for selective widening of the drilling radius beyond that utilized in drilling the sinking hole, said expandable cutting means having two primary cutting blades which are alternatively selectable by reversing the rotational direction of the said drill bit means by changing the rotational direction of said shaft means and wherein said rotatable shaft means is generally hollow and capable of transmitting liquids and wet concrete from said first end to said second end of said pile.

2. A pre-fabricated concrete foundation pile assembly as defined in claim 1 further comprising sealing means disposed between said rotatable shaft and said axial bore for producing a general liquid-tight seal between the two.

3. A method for installing a pre-fabricated concrete foundation pile having an axial passage in the pile, a generally hollow rotatable shaft removably disposed within and extending from each end of the pile, a drill bit coupled to one end of the shaft and rotatably supported on the pile and driving means coupled to the other end of the shaft comprising the steps of:

a. suspending the foundation pile above the installation side in a manner which prevents rotation of the pile;

b. rotation the drill bit by means of the rotatable shaft and the driving means to create a hole for sinking the pile;

c. lowering the pile as the sinking hole is created;

d. flushing a flushing liquid through the hollow rotatable shaft to cause the drillings to be expelled from the sinking hole as the hole is created;

e. releasing the hollow rotatable shaft from the drill bit and withdrawing the shaft from the axial passage in the pile and f. ramming the pile into the hole after layers of bearing earth have been reached.

4. The method for installing a pre-fabricated concrete foundation pile as defined in claim 3 further comprising the steps of:

a. partially withdrawing the pile after layers of bearing ground have been reached in a desired hole depth;

b. injecting wet concrete through the axial passage in the pile after removal of the hollow rotatable shaft; and c. lowering the pile back into the sinking hole.

5. A method for installing a pre-fabricated concrete foundation pile assembly as defined in claim 20 wherein the withdrawing step is preceded by the steps of:

a. expanding the drill bit to a radius larger than the radius of the sinking hole by reversing the direction of rotation of the drill bit by the hollow shaft means;

b. rotating the expanded drill bit in the reversed direction of rotation to enlarge the base of the sinking hole; and c. contracting the drill bit radius by again reversing the rotational direction of the drill bit to accommodate partial withdrawal of the pile.

6. A method for installing a pre-fabricated concrete foundation pile assembly as defined in claim 4 further comprising the step of:

a. ramming the pile into the hole after lowering the pile through the concrete layer.

7. A method for installing a pre-fabricated concrete foundation pile assembly as defined in claim 3 further comprising the step of:

a. filling the axial passage with concrete after withdrawing the shaft.

8. A method for installing a pre-fabricated concrete foundation pile assembly as defined in claim 3 further comprising the steps of:

a. injecting a thixotropic substance into the sinking hole thereby displacing the remaining flushing liquid in the hole while the pile is in a lowered position and b. partly withdrawing the pile while simultaneously injecting wet concrete to thereby partly displaced the thixotropic substance from the bottom of the hole.

9. A method for installing a pre-fabricated concrete foundation pile assembly as defined in claim 8, wherein the thixotropic substance is a bentonite suspension.

* * * * *